US006769956B1

(12) United States Patent
Konieczny

(10) Patent No.: US 6,769,956 B1
(45) Date of Patent: Aug. 3, 2004

(54) APPARATUS AND METHOD FOR RAPID, PRECISE POSITIONING OF A GRIT-BLASTING NOZZLE

(75) Inventor: Matthew R. Konieczny, Butler, PA (US)

(73) Assignee: Oberg Industries, Freeport, PA (US)

( * ) Notice: Subject to any disclaimer, the term of this patent is extended or adjusted under 35 U.S.C. 154(b) by 132 days.

(21) Appl. No.: 10/067,188

(22) Filed: Feb. 4, 2002

(51) Int. Cl.[7] ..... B24B 49/00; B24B 51/00

(52) U.S. Cl. ..... 451/2; 451/38; 451/40; 451/102

(58) Field of Search ..... 451/2, 38, 39, 451/40, 102

(56) References Cited

U.S. PATENT DOCUMENTS 3,710,515 A * 1/1973 Kulischenko et al. ..... 451/75
3,845,586 A * 11/1974 Callahan et al. ..... 451/2
3,866,357 A * 2/1975 Callahan et al. ..... 451/2
4,566,560 A 1/1986 Elliott et al.
4,784,421 A * 11/1988 Alvite ..... 294/86.4
4,845,903 A 7/1989 Woodward
5,048,316 A 9/1991 Thompson
5,759,086 A * 6/1998 Klingel ..... 451/28
5,833,516 A * 11/1998 De Haas et al. ..... 451/29
6,244,927 B1 6/2001 Zeng

* cited by examiner

*Primary Examiner*—Timothy V. Eley
(74) *Attorney, Agent, or Firm*—William F. Lang IV; Eckert Seamans Cherin & Mellott, LLC

(57) ABSTRACT

A grit blasting nozzle and nozzle fixture assembly provides for both rapid installation of the nozzle within the fixture, and precise alignment of the nozzle when installed in the fixture. Corresponding flat surfaces and shoulders on the nozzle and nozzle fixture orient the nozzle within the fixture, and a spring-biased pin engages an angled surface in the nozzle housing to fully seat the nozzle within the fixture. A proximity sensor facilitates consistent setting of the proper distance between the nozzle and the workpiece.

12 Claims, 8 Drawing Sheets

APPARATUS AND METHOD FOR RAPID, PRECISE POSITIONING OF A GRIT-BLASTING NOZZLE

BACKGROUND OF THE INVENTION

1. Field of the Invention

The present invention relates to grit-blasting nozzles and their support fixtures. More specifically, the invention provides a grit-blasting nozzle mating with a support fixture in a manner that provides precise, identical alignment every time it is installed, and a method for precisely setting the proximity of the nozzle to the workpiece.

2. Description of the Related Art

Grit blasting is presently utilized as a step in a variety of manufacturing processes. Typically, aluminum oxide particles of a selected size are directed against the surface to be grit-blasted by compressed air, or possibly by a fluid such as water. The goal of the grit-blasting process is often to create a surface having a roughness within a certain range, which is achieved by varying the size of the alumina grit, the air pressure, the size of the nozzle opening, and/or the distance of the nozzle from the workpiece. Additionally, grit blasting may be used to precisely cut holes, for example, in silicon wafers. It is therefore necessary to precisely control these variables during the grit blasting process. Additionally, the grit blasting nozzle and hose leading to the nozzle will typically be subject to a high degree of wear due to the highly abrasive alumina grit constantly passing through them at high pressure. Therefore, it is necessary to replace the nozzle and hoses not only to achieve different surface roughnesses and/or different holes with different manufacturing processes, but also to minize machine downtime when replacing worn out components.

The time necessary to replace presently available grit blasting nozzles reduces the overall productivity of the grit blasting operation. Additionally, lack of repeatability of adjustment settings may result in increased variation in the results of the grit blasting operation, and a corresponding decrease in overall component quality. Accordingly, there is a need for a grit blasting apparatus having a nozzle. capable of being quickly installed into its fixture, and precisely aligned when it is within the fixture. Additionally, there is a need for a grit blasting apparatus having means for precisely adjusting the distance between the nozzle and the workpiece.

SUMMARY OF THE INVENTION

The present invention provides an apparatus and method for precisely aligning a grit blasting nozzle. The invention includes a movable bracket, a nozzle dimensioned and configured for rapid, precise installation within the movable bracket, and may also optionally include a fixed bracket with at least one proximity sensor.

The nozzle housing includes a flat surface and a shoulder, with each being dimensioned and configured to abut a corresponding surface on the movable fixture bracket. The nozzle also defines a means for being secured at exactly the same height with respect to the movable bracket each and every time it is utilized. Specifically, one preferred embodiment includes an angled surface on the nozzle housing dimensioned and configured to abut a spring-biased hinge within the movable bracket. When the nozzle. is inserted into the movable bracket, the pressure of the spring-biased pin against the angled surface will push the nozzle further into the bracket until the shoulder on the housing abuts the bracket, thereby precisely locating the nozzle in the same position relative to the bracket each and every time the nozzle is inserted into the bracket.

The movable bracket includes a first arm dimensioned and configured to removably secure the grit blasting nozzle, a second arm dimensioned and configured to removably secure a proximity sensor, and a grit blasting machine engaging portion dimensioned and configured for sliding motion within a desired range of distances from the workpiece. The movable bracket may, if desired, also include means for removably securing a light source dimensioned and configured to provide light to the target area of the workpiece.

If a proximity sensor is desired, then the fixed bracket will be used to support either the sensor or the sensor's target. The fixed bracket therefore include means for being secured to the grit blasting machine in close proximity to the movable bracket, and an arm dimensioned and configured to removably secure a proximity sensor or a sensor target.

A proximity sensor secured within one bracket may be utilized to detect the distance between the proximity sensor and the proximity sensor target on the opposing bracket, from which the distance between the nozzle and the workpiece target region can be calculated. One preferred proximity sensor is an inductive resistance proximity sensor, which is well known in the art of proximity sensors.

BRIEF DESCRIPTION OF THE DRAWINGS

Like reference numbers denote like elements throughout the drawings.

DETAILED DESCRIPTION

Figure 1:
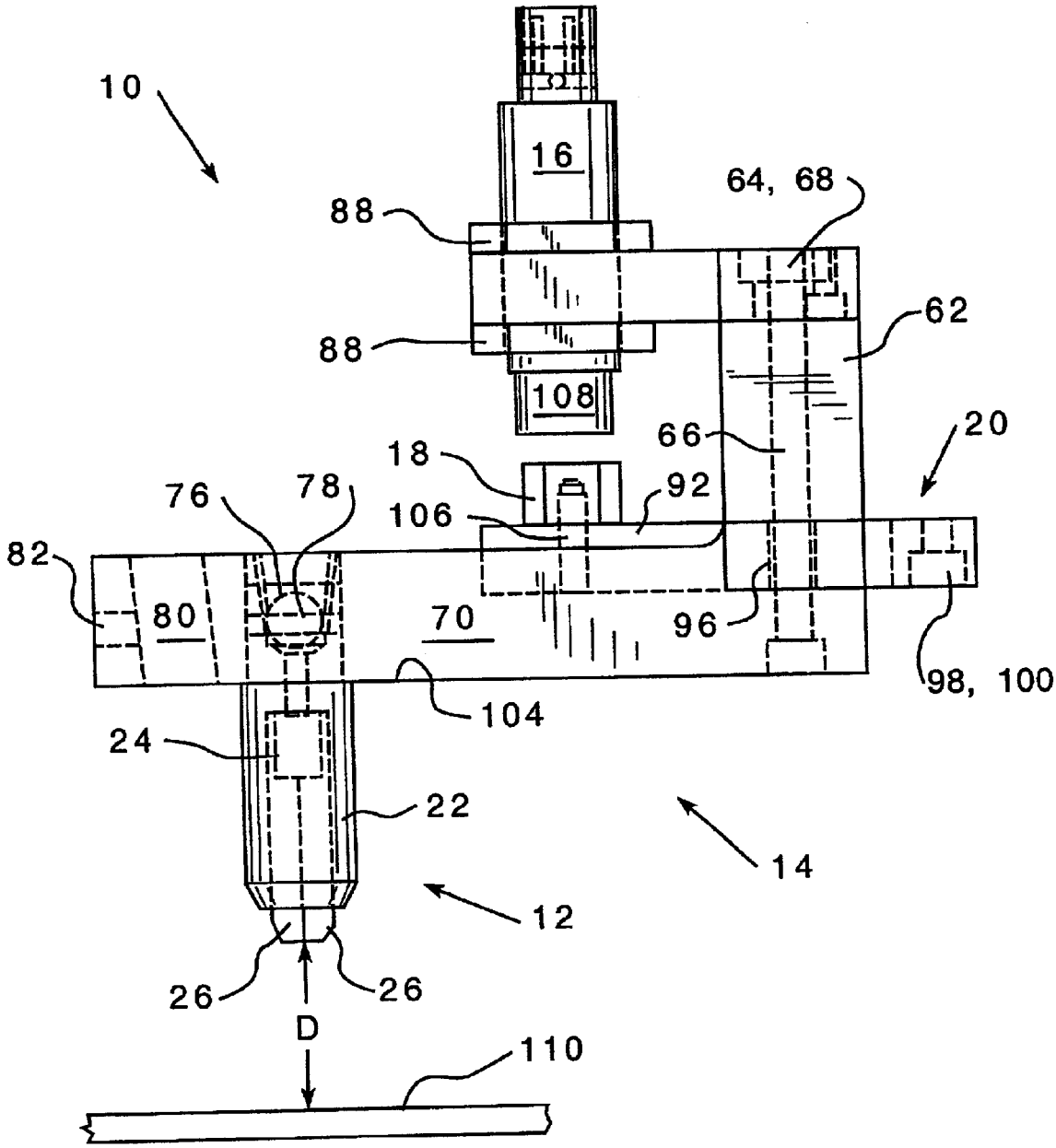
FIG. 1 is a side view of a grit blasting nozzle and fixture assembly according to the present invention.
Figure 2:
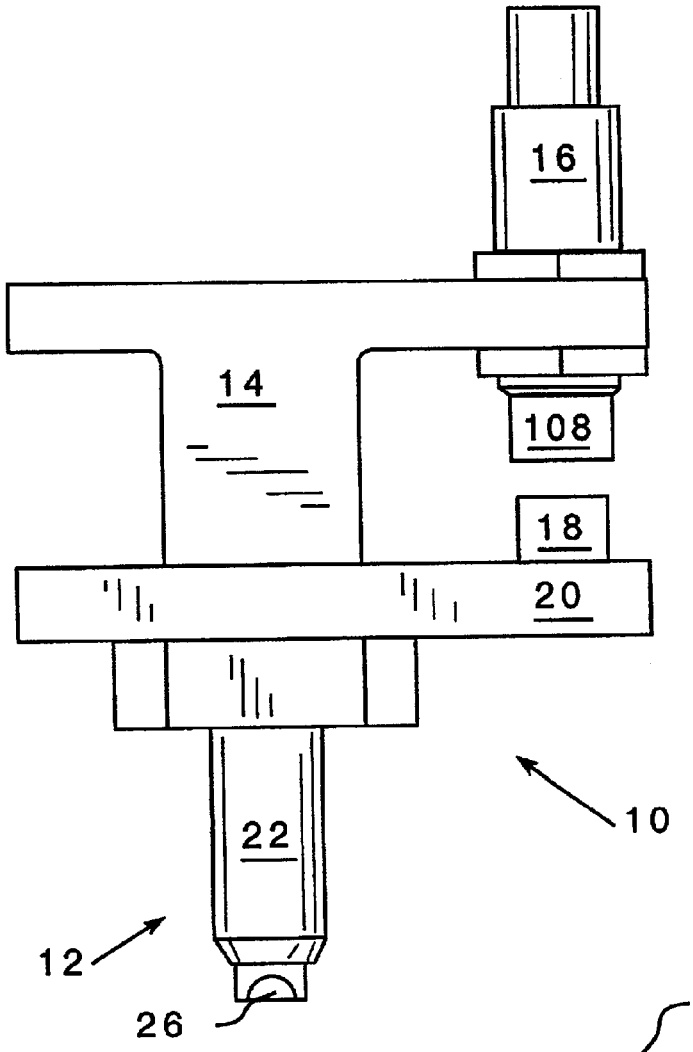
FIG. 2 is a back view of a grit blasting nozzle and fixture assembly according to the present invention.
Figure 3:
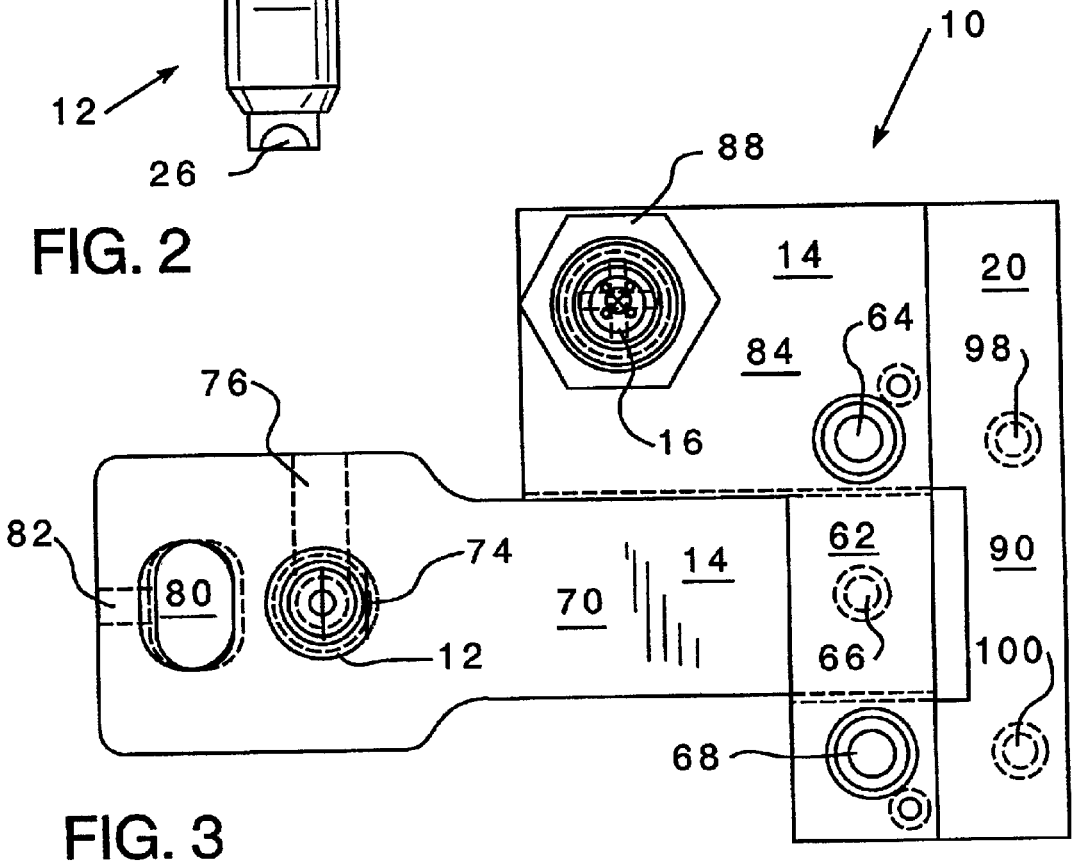
FIG. 3 is a top view of a grit blasting nozzle and fixture assembly according to the present invention.

The present invention provides an improved grit blasting nozzle and fixture assembly 10. Referring to FIGS. 1–4, a preferred embodiment of the grit blasting assembly 10 includes a nozzle assembly 12, removably secured within a movable fixture assembly 14. The movable fixture assembly 14 also includes a proximity sensor 16 working in conjunction with a proximity sensor target 18 removably secured to a fixed bracket 20.

Figure 5:
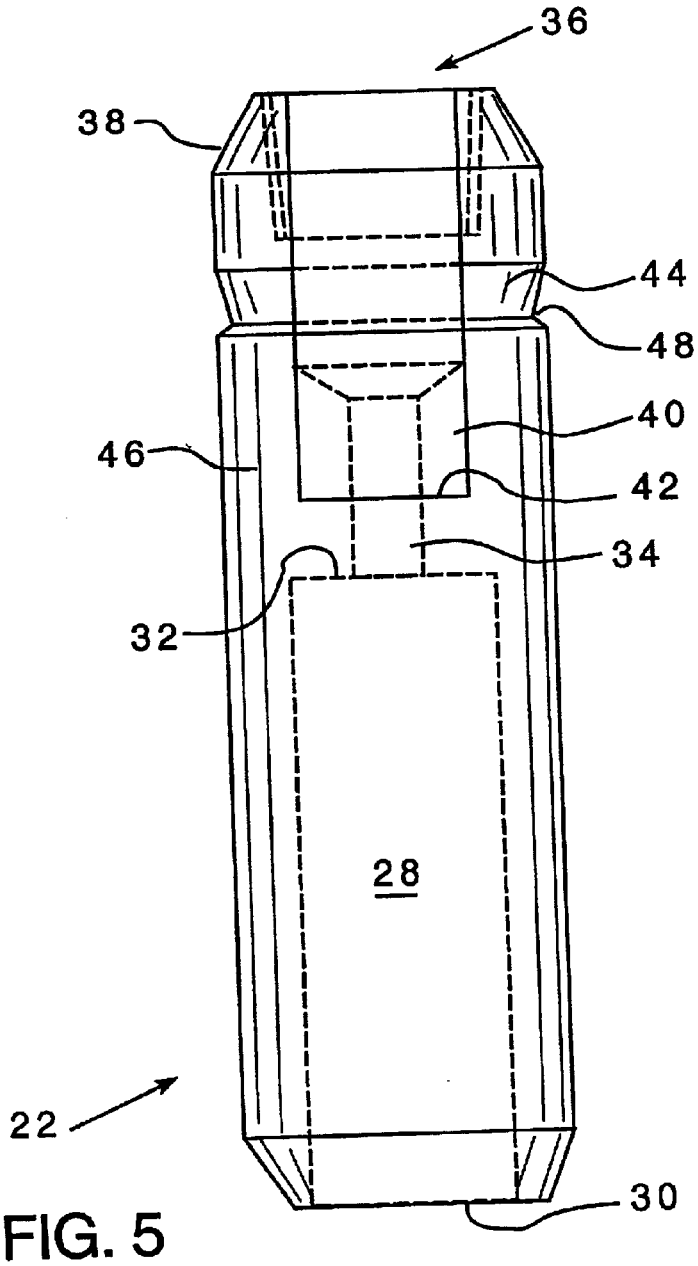
FIG. 5 is a side view of a nozzle housing according to the present invention.
Figure 6:
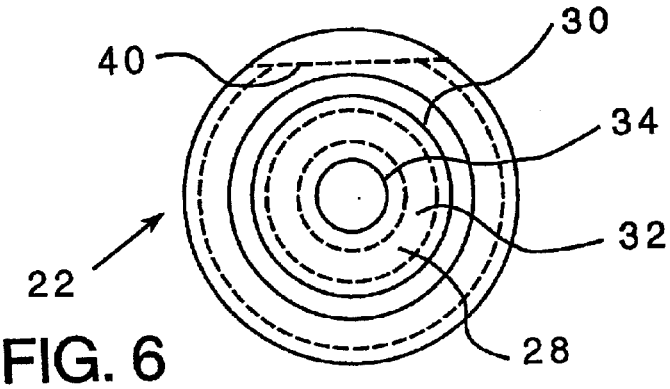
FIG. 6 is a bottom view of a nozzle housing according to the present invention.

Referring to FIGS. 5–6, the nozzle assembly 12 includes a nozzle housing 22, defining a channel dimensioned and configured to receive a spacer 24 and a pair of nozzle half-portions 26 (described below, FIGS. 7–8, 11–12). The nozzle receiving channel 28 includes an open lower end 30, and an upper end 32 in communication with a grit passage channel 34. The grit passage channel 34 includes an upper opening 36 at the top end 38 of the nozzle housing 22. The nozzle housing 22 is preferably cylindrical, but includes an alignment guide surface 40 at its upper end. The alignment guide surface 40 is preferably flat. The bottom of the alignment guide surface 40 forms a shoulder 42. The top section 38 of the housing 22 also preferably includes a taper portion 44, thereby forming a camming surface. The bottom of the tapered portion or camming surface 44, in conjunction with the cylindrical housing portion 46, defines a concave corner 48.

Figure 4:
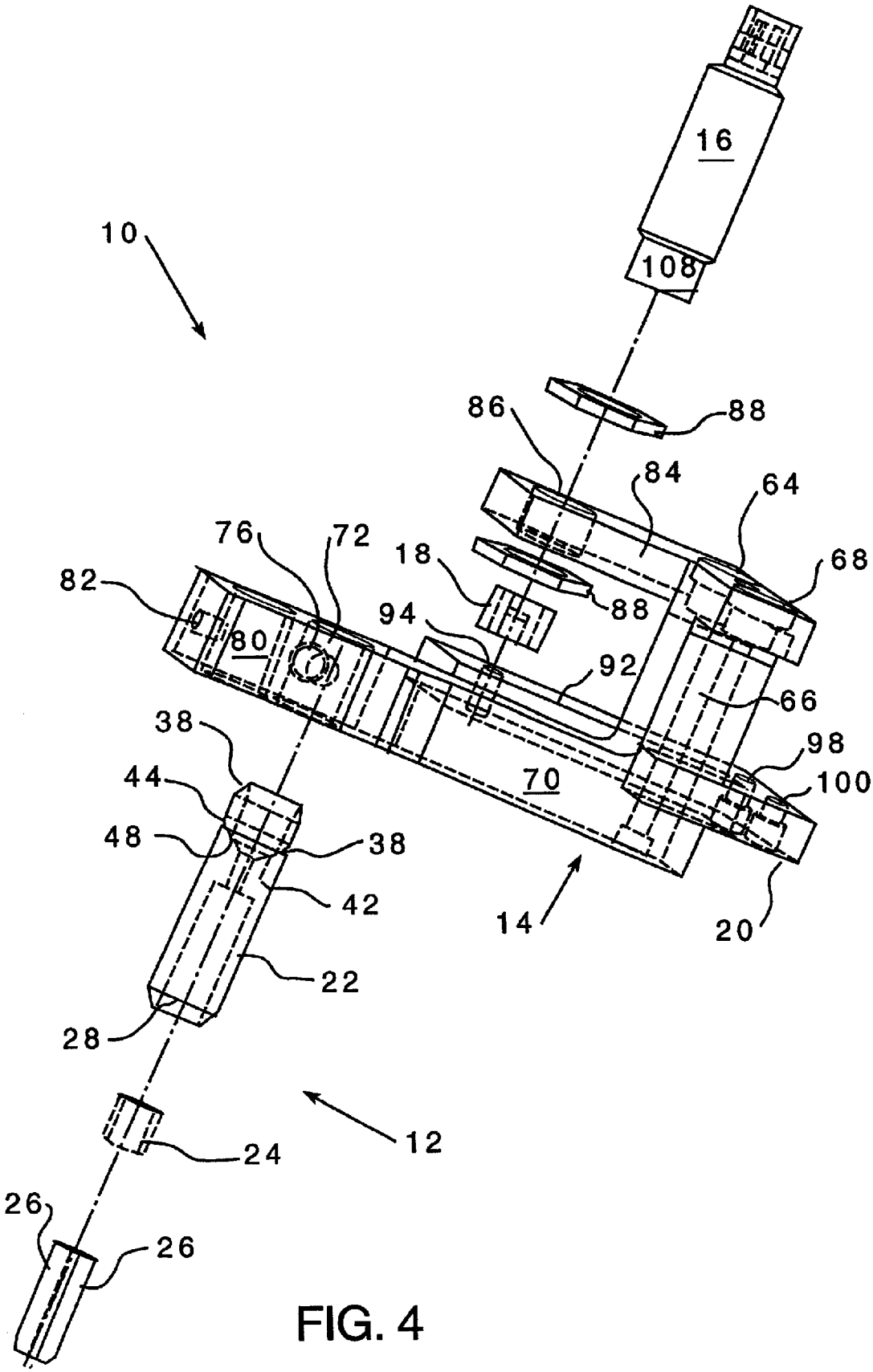
FIG. 4 is an exploded side view of a grit blasting nozzle and fixture assembly according to the present invention.
Figure 11:
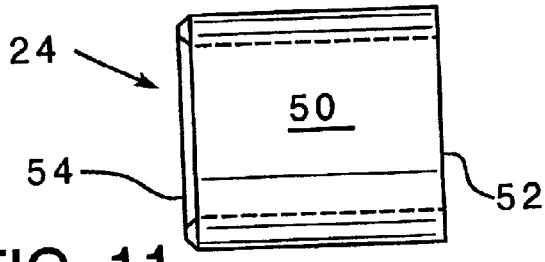
FIG. 11 is a side view of a nozzle spacer according to the present invention.
Figure 12:
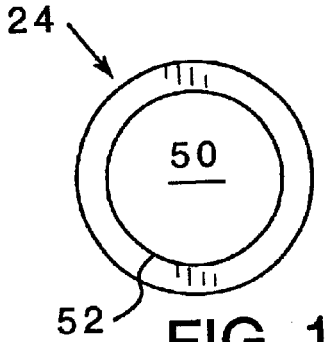
FIG. 12 is an end view of a nozzle spacer according to the present invention.

Referring to FIGS. 11 and 12, a spacer 24 is illustrated. The spacer 24 includes a mixing chamber 50, having a pair of open ends 52, 54. Referring briefly to FIG. 4, the spacer 24 is dimensioned and configured to fit within the upper end 32 of the nozzle receiving channel 28 of the nozzle housing 22.

Figure 7:
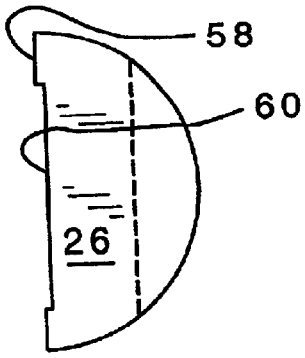
FIG. 7 is an end view of one of two mirror image, mating nozzle components according to the present invention.
Figure 8:
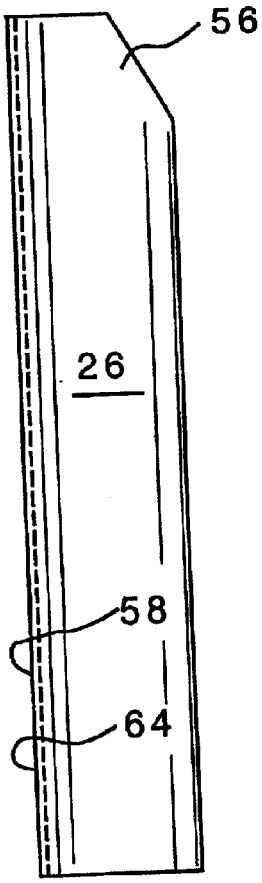
FIG. 8 is a side view of one of two mirror image, mating nozzle components according to the present invention.

Referring to FIGS. 7 and 8, one of two mirror image nozzle half-portions 26 is illustrated. Each nozzle half-portion 26 has the form of one-half of a cylinder, including a tapered tip portion 56. The interior surface 58 includes a half channel portion 60, extending lengthwise down the nozzle half-portion 26. Referring back to FIG. 4, two identical nozzle half-portions 26 will be placed together with their interior surfaces 58 abutting each other. Both nozzle half-portions 26 will then be inserted into the nozzle receiving channel 28 of the nozzle housing 22. It will preferably be necessary to very slightly crush the two nozzle half-portions 26 to fit them within the channel 28, thereby creating an interference fit between the channel 28 and nozzle half-portions 26 to retain the nozzle half-portions 26 within the nozzle housing 22. The two half channel portions will thereby form a channel, which in the present example is substantially planar, having twice the width of each half channel portion 60.

Figure 13:
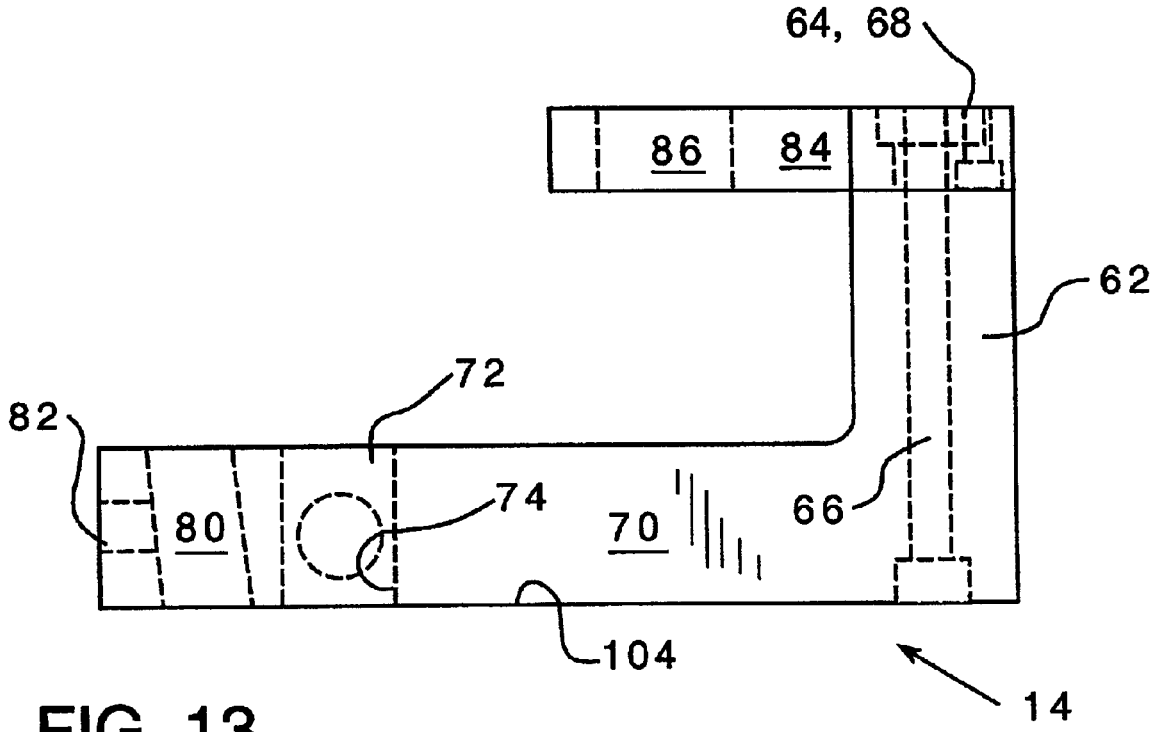
FIG. 13 is a side view of a movable fixture bracket according to the present invention.
Figure 14:
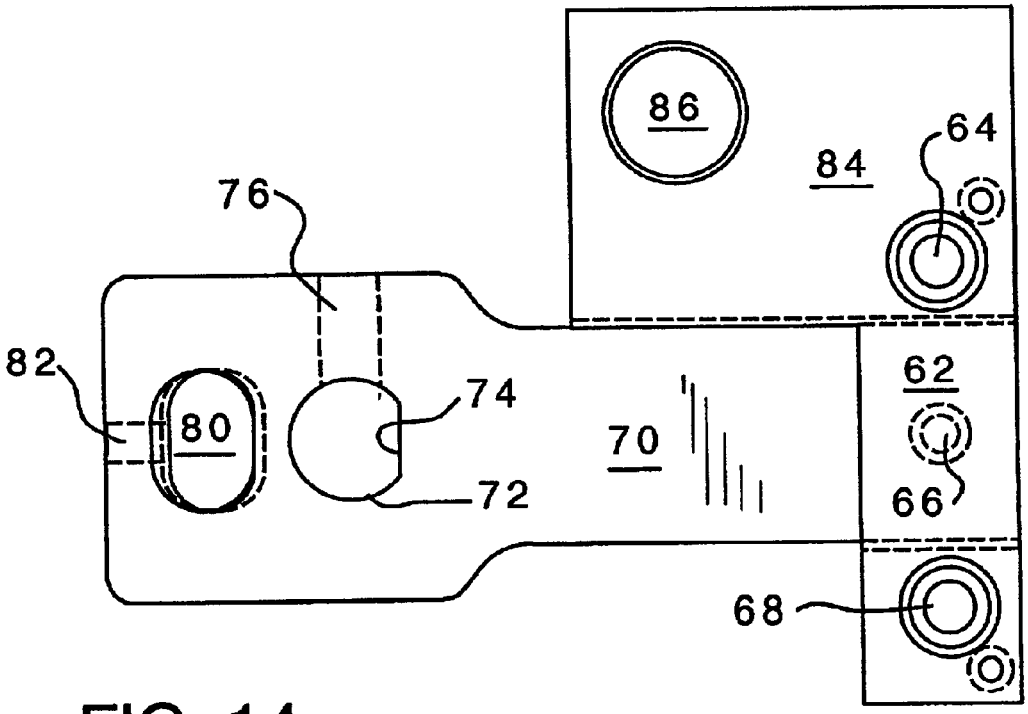
FIG. 14 is a top view of a movable fixture bracket according to the present invention.
Figure 15:
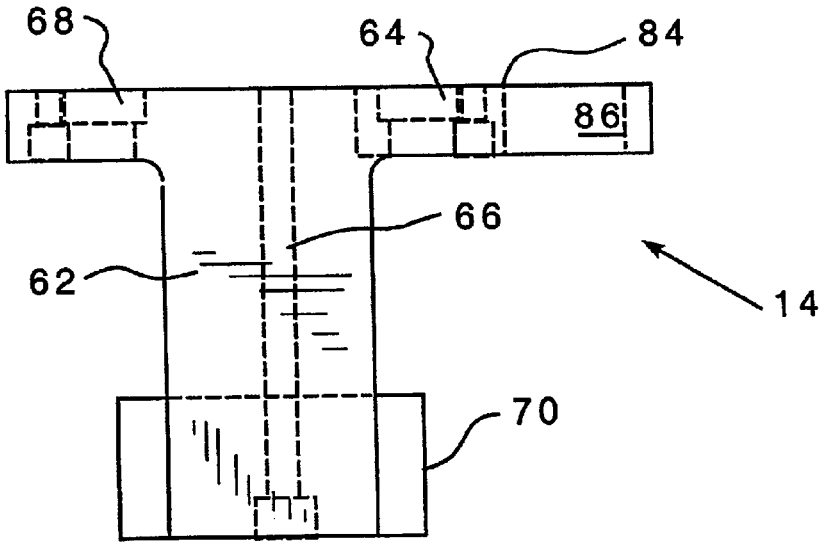
FIG. 15 is a back view of a movable fixture bracket according to the present invention.

Referring to FIGS. 13–15, a movable bracket 14 is illustrated. The movable bracket 14 includes a grit blasting machine-engaging portion 62, dimensioned and configured for sliding motion within a desired range of distances from the workpiece. Some preferred embodiments may include one or more channels 64, 66, 68, for slidably mating with a rod (not shown and well understood in the art of grit blasting) attached to the grit blasting machine. A first arm 70 extends from the machine-engaging portion 62, with the first arm 70 being dimensioned and configured to removably secure the nozzle assembly 12. The first arm 70 preferably defines an aperature 72, dimensioned and configured to receive the top end 38 of the nozzle housing 22. The aperture 72 will therefore be generally cylindrical, with an alignment guide surface 74 dimensioned and configured to abut the alignment guide surface 40. The alignment guide surface 74 is therefore preferably flat if a flat alignment guide surface 40 is used. A nozzle-securing aperture 76 is in communication with the aperture 72. Referring briefly to FIG. 1, the nozzle-securing aperture 76 preferably contains a spring-biased cylindrical pin 78, dimensioned and configured to abut the concave corner 48 of the nozzle housing 22. Some preferred embodiments of the first arm 70 may also include a light source retaining aperture 80, which may be angled to point a light source towards the target area of the workpiece, directly beneath the nozzle assembly 12, and which may be either a fixed or an adjustable aperture. A light source securing aperture 82, in communication with the light source retaining aperture 80, permits insertion and/or installation of a means for securing a light source within the aperture 80, for example, a spring-biased pin, or possibly a removable pin. The movable bracket 14 also includes a second arm 84, dimensioned and configured to removably secure a proximity sensor 16. The second arm 84 may include an aperture 86, dimensioned and configured to receive the proximity sensor 16. Referring briefly to FIGS. 1 and 4, one or more nuts 88 may be secured to the proximity sensor 16, above and below the second arm 84, thereby removably securing the proximity sensor 16 within the aperture 86.

Figure 9:
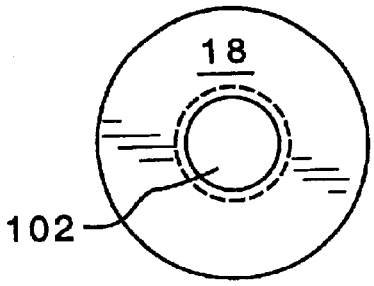
FIG. 9 is an end view of a proximity sensor target according to the present invention.
Figure 10:
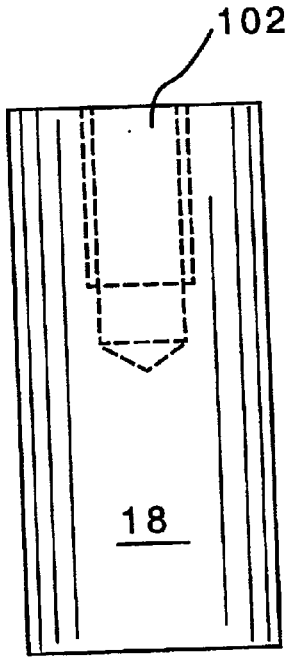
FIG. 10 is a side view of a proximity sensor target according to the present invention.
Figure 16:
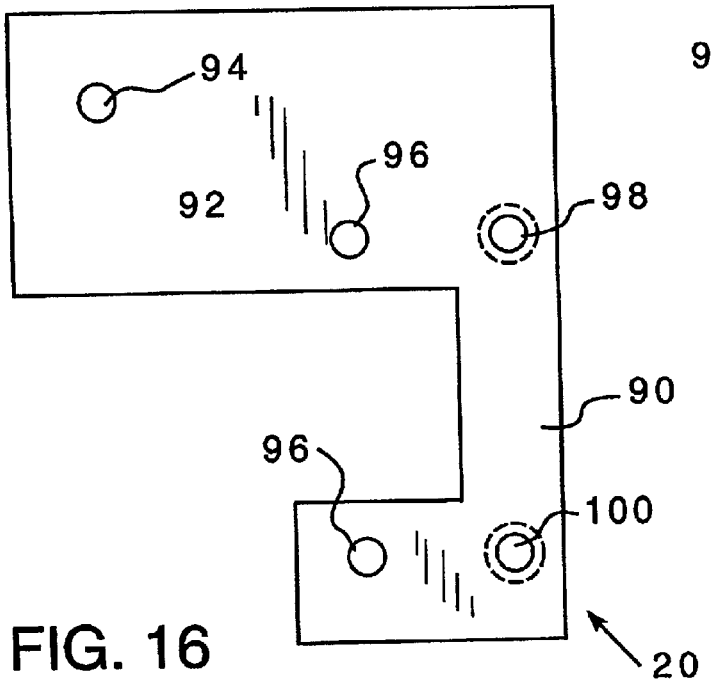
FIG. 16 is a top view of a fixed fixture bracket according to the present invention.
Figure 17:
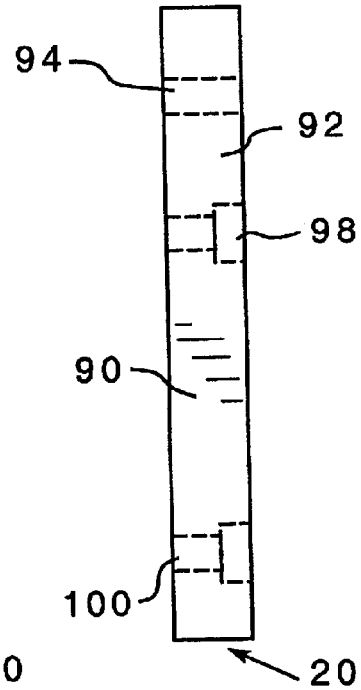
FIG. 17 is a back view of a fixed fixture bracket according to the present invention.
Figure 18:
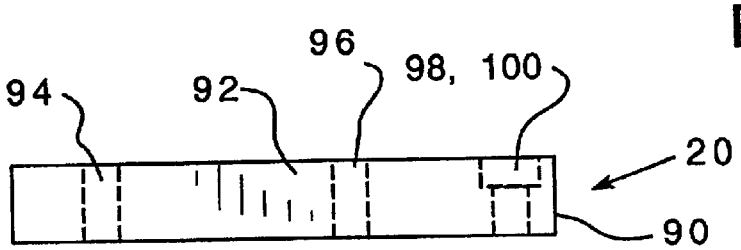
FIG. 18 is a side view of a fixed fixture bracket according to the present invention.

Referring to FIGS. 16–18, a fixed bracket 20 is illustrated. The fixed bracket 20 includes a grit blasting machine-engaging portion 90 having one or more channels 98, 100, for mating with a rod (not shown and well understood in the art of grit blasting) attached to the grit blasting machine, thereby securing the bracket 20 to the grit blasting machine, and an arm 92 having means for removably securing a target 18 for a proximity sensor 16, for example, the aperture 94. The fixed bracket 20 may optionally include channels 96, for aligning the fixed bracket 20 with the movable bracket 14. Referring to FIGS. 9 and 10, a proximity sensor target 18 is illustrated. The proximity sensor target 18 is preferably made from ferromagnetic material, and includes means for being secured to the arm 92 of the fixed bracket 20. These means may include an aperture 102, for receiving a pin 106 passing through the apertures 102, 94, thereby securing the proximity sensor target 18 to the arm 92.

Referring to FIGS. 1–4, a preferred proximity sensor 16 may be a presently known inductive proximity sensor. Such a sensor typically includes a coil within the sensor head or tip 108 which, when brought in close proximity to the proximity sensor target 18, the presence of the metal within the high frequency field radiated from the sensor head increases the electrical resistance within the sensor head, thereby decreasing the amount of current permitted to pass through the sensor head for a given voltage. Therefore, current can be correlated with the distance between the proximity sensor 16 and proximity sensor target 18, and therefore also with the distance between the nozzle assembly 12 and the workpiece. As will be known to those skilled in the art, a microprocessor with stored data correlating various current values to the corresponding distance between the sensor 16 and sensor target 18 will be used to compare the output of the sensor with these stored values, to determine when the desired distance has been reached. When the desired distance is reached, the microprocessor may either display an audible or visible signal (if the distance D is manually set) or may transmit an electronic system to the controller of the grit blasting machine to stop movement of the movable bracket 14 (if an automated system, such as a computer-numerically-controlled (CNC) system, is used to move the movable bracket 14)

Figure 19:
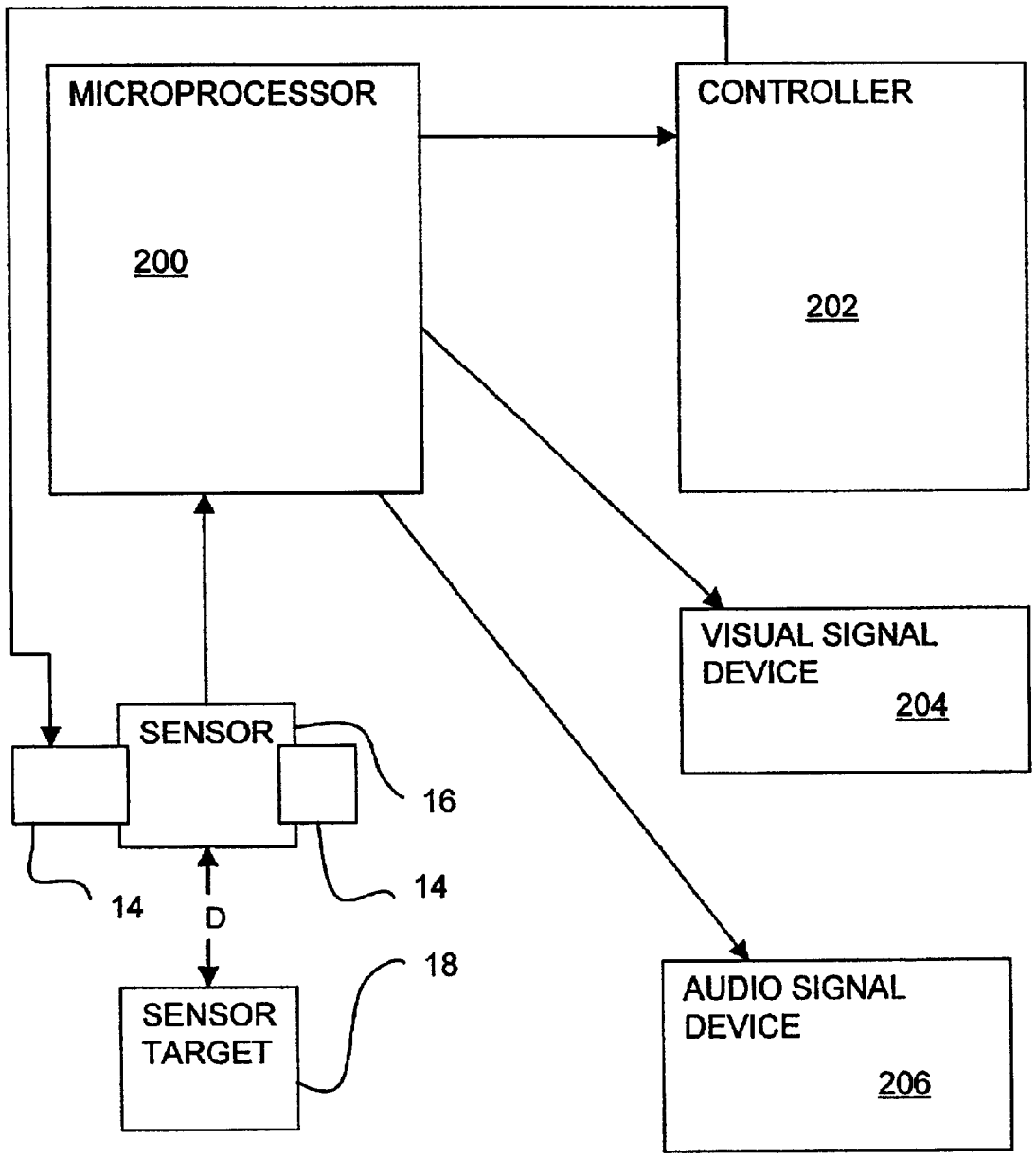
FIG. 19 is a schematic view of a sensor, microprocessor, and associated components for use with the present invention.

Referring to FIG. 19, the sensor 16 is illustrated in communication with a microprocessor 200. As the sensor 16 is brought towards the desired distance D from the sensor target 18, information about the amount of current within the sensor 16 is transmitted to the microprocessor 200 on an ongoing basis. The microprocessor 200 will then compare the current measurement with the known current measurements and corresponding distances D stored within the microprocessor 200. Once the desired distance D is reached, the microprocessor 200 will signal that movement of the movable bracket 14 should stop moving. If the movement of the movable bracket 14 is automated, then the microprocessor 200 will send a signal to stop the controller 202 from moving the movable bracket 14. If the movement of the movable bracket 14 is manual, than the microprocessor 200 will send a signal to the visual signal device 204, such as a light, or an audio signal device 206, such as a speaker, so that the signal device 204,206 will signal the operator to stop moving the movable bracket 14.

Referring back to FIGS. 1–4, the top end 38 of the nozzle assembly 12 will be inserted into the aperture 72, with the corresponding surfaces 40, 74 ensuring that the two channel halves 60 form a channel having the proper orientation. The spring-biased pin 78 pushes against the tapered portion or camming surface 44 pushes the nozzle assembly 12 upward within the aperture 74, until the shoulder 42 abuts the bottom surface 104 of the first arm 70. The nozzle assembly 12 is thereby precisely and repeatably secured in a constant orientation within the movable bracket 14. The hose carrying the grit and compressed air may then be connected to the top end 38 of the nozzle assembly 12 using means well known in the art of grit blasting.

With the position of the nozzle 12 with respect to the movable bracket 14 precisely set, the distance D between the nozzle assembly 12 and the target area of the workpiece 110 can be controlled by setting the appropriate distance between the proximity sensor 16 and proximity sensor target 18, accomplished by moving the movable bracket 14 relative to the fixed bracket 20. The movable bracket 14 is therefore raised and/or lowered until the desired amount of electrical current is flowing through the proximity sensor 16, indicating that the movable bracket 14 is the proper distance from the fixed bracket 20, and the nozzle assembly 12 is therefore the proper distance D from the target area of the workpiece 110. Grit blasting of the workpiece 110 may then be conducted in a conventional manner.

While a specific embodiment of the invention has been described in detail, it will be appreciated by those skilled in the art that various modifications and alternatives to those details could be developed in light of the overall teachings of the disclosure. For example, the location of the proximity sensor and sensor target may be reversed, or indicia denoting various distances D may be used as an alternative to a proximity sensor for positioning the movable bracket at a desired distance D from the workpiece. Accordingly, the particular arrangements disclosed are meant to be illustrative only and not limiting as to the scope of the invention which is to be given the full breadth of the appended claims and any and all equivalents thereof.

What is claimed is:

1. A method of grit blasting, comprising:

providing a movable bracket comprising:

a grit blasting machine engaging portion dimensioned and configured for slidable mounting on a grit blasting machine;

a first arm dimensioned and configured to removably secure a grit blasting nozzle assembly, and to repeatably and precisely position said nozzle in substantially the same desired position; and a second arm having means for removably securing a proximity sensor on said movable bracket;

providing a fixed bracket, comprising:

a grit blasting machine engaging portion; and means for removably securing a proximity sensor target;

providing a proximity sensor dimensioned and configured to provide an indicia of distance between said proximity sensor and said proximity sensor target;

securing said grit blasting nozzle assembly within said first arm;

securing said proximity sensor within said second arm; and moving said movable bracket until said proximity sensor indicates that a desired distance between said nozzle and a workpiece has been achieved.

2. A grit blasting assembly for use with a grit blasting machine, said grit blasting assembly comprising:

a movable bracket having means to removably secure a nozzle assembly therein, and to repeatably position said nozzle therein in a substantially identical manner, said movable bracket being slidably moveable within a range of desired distances from a workpiece;

said means for removably securing said nozzle assembly, and for repeatably positioning said nozzle therein in a substantially identical manner, include:

a camming surface on said nozzle assembly;

a shoulder on said nozzle assembly; and a spring-biased pin within said movable bracket, said spring-biased pin being dimensioned and configured to push against said camming surface, and to cause said shoulder to abut said movable bracket; and means for repeatedly and precisely positioning said nozzle substantially at a desired distance from said workpiece.

3. The grit blasting assembly according to claim 2, further comprising corresponding alignment guide surfaces on said nozzle assembly and said movable bracket.

4. A grit blasting assembly for use with a grit blasting machine, said grit blasting assembly comprising:

a movable bracket having means to removably secure a nozzle assembly therein, and to repeatably position said nozzle therein in a substantially identical manner, said movable bracket being slidably moveable within a range of desired distances from a workpiece; and means for repeatedly and precisely positioning said nozzle substantially at a desired distance from said workpiece; and said means for removably securing said nozzle assembly, and for repeatably positioning said nozzle therein in a substantially identical manner, include a proximity sensor, and a corresponding proximity sensor target.

5. The grit blasting assembly according to claim 4, wherein said proximity sensor is an inductive proximity sensor.

6. The grit blasting assembly according to claim 4:

further comprising a fixed bracket; and wherein one of said proximity sensor and said proximity sensor target is removably secured to said movable bracket, and the other of said proximity sensor and said proximity sensor target is removably secured to said fixed bracket.

7. A grit blasting assembly for use with a grit blasting machine, said grit blasting assembly comprising:

a proximity sensor;

a proximity sensor target;

a movable bracket comprising:

a grit blasting machine engaging portion dimensioned and configured for slidable mounting on said grit blasting machine; and a first arm dimensioned and configured to removably secure a grit blasting nozzle assembly, and to repeatably and precisely position said nozzle in substantially the same desired position.

8. The grit blasting assembly according to claim 7, further comprising:

a camming surface on said nozzle assembly;

a shoulder on said nozzle assembly; and a spring-biased pin within said movable bracket, said spring-biased pin being dimensioned and configured to push against said camming surface, and to cause said shoulder to abut said movable bracket.

9. The grit blasting assembly according to claim 8, further comprising corresponding alignment guide surfaces on said nozzle assembly and said movable bracket.

10. The grit blasting assembly according to claim 7, further comprising:

a second arm having means for removably securing a device selected from the group consisting of said proximity sensor and said proximity sensor target; and a fixed bracket, comprising:

a grit blasting machine engaging portion; and means for removably securing a device selected from the group consisting of said proximity sensor and said proximity sensor target.

11. The grit blasting assembly according to claim 10, further comprising corresponding alignment guide surfaces on said nozzle assembly and said movable bracket.

12. The grit blasting assembly according to claim 10, wherein said proximity sensor is an inductive proximity sensor.

* * * * *

UNITED STATES PATENT AND TRADEMARK OFFICE

CERTIFICATE OF CORRECTION

PATENT NO. : 6,769,956 B1
DATED : August 3, 2004
INVENTOR(S) : Matthew R. Konieczny It is certified that error appears in the above-identified patent and that said Letters Patent is hereby corrected as shown below:

Column 1,
Line 34, "minize" should read -- minimize --.
Line 42 and 65, remove the "." after "nozzle".

Signed and Sealed this

Twenty-ninth Day of March, 2005

JON W. DUDAS
*Director of the United States Patent and Trademark Office*